United States Patent [19]

Vilchek

[11] 4,406,349

[45] Sep. 27, 1983

[54] ESCAPE APPARATUS

[76] Inventor: Andrew Vilchek, 12612 Pawnee Rd., Palos Park, Ill. 60464

[21] Appl. No.: 265,203

[22] Filed: May 19, 1981

[51] Int. Cl.[3] ..... A62B 1/02

[52] U.S. Cl. ..... 182/7; 182/82; 187/6

[58] Field of Search ..... 182/234, 235, 36, 82, 182/83, 37, 39, 239, 71, 72, 75, 3, 7; 187/6, 8, 19

[56] References Cited

U.S. PATENT DOCUMENTS

| | | | |
|---|---|---|---|
| 278,858 | 6/1883 | Bills . | |
| 473,572 | 4/1892 | Gunnarson | 187/8 |
| 481,252 | 8/1892 | Brainard . | |
| 489,463 | 1/1893 | Coker | 182/72 |
| 553,299 | 1/1896 | Campbell | 187/8 |
| 619,105 | 2/1899 | Watson | 182/37 |
| 1,202,571 | 10/1916 | Olsen . | |
| 2,543,348 | 2/1951 | Briese | 182/37 |
| 2,549,707 | 4/1951 | Plummer . | |
| 2,647,675 | 6/1947 | Bernett . | |
| 3,207,263 | 7/1962 | Cull . | |
| 3,915,432 | 10/1975 | Bustamante | 182/239 |
| 3,944,021 | 3/1976 | Smith | 182/36 |
| 3,946,836 | 3/1976 | Maack . | |
| 4,026,385 | 5/1977 | Murukurthy | 182/75 |
| 4,121,689 | 10/1978 | Bonvin | 187/6 |
| 4,191,275 | 3/1980 | Mansfield . | |

*Primary Examiner*—Reinaldo P. Machado
*Assistant Examiner*—Alvin Chin-Shue
*Attorney, Agent, or Firm*—Hume, Clement, Brinks, Willian & Olds, Ltd.

[57] ABSTRACT

An emergency escape apparatus includes a gear track mounted vertically on an exterior surface of a building. A carriage is provided with guide rollers which engage a guide track oriented adjacent and parallel to the gear track. A gear wheel is rotatably mounted on the carriage and is maintained in positive engagement with the gear track by the guide rollers. The carriage includes automatic brakes which serve to limit the maximum downward velocity of the carriage, and a boatswain's chair is attached to the carriage to secure one or more persons to the carriage for transport down the outside of the building.

8 Claims, 7 Drawing Figures

ESCAPE APPARATUS

BACKGROUND OF THE INVENTION

This invention relates to an improved system for safely, reliably, and automatically transporting persons down from an elevated structure, and in particular to such a system as adapted for use in a fire escape system.

In the event of fire in a dwelling or an office building, conventional escape routes may often be unusable. For example, elevators can become disabled in times of fire, and in any event it is generally advisable to avoid elevators during fire emergencies and the resulting danger of being trapped between floors by a power failure. In addition, stairways can become smoke filled, and outside rescue equipment such as hook and ladder trucks, snorkel trucks and the like are not always available and are not always capable of reaching the necessary height. Thus, a need exists for a simple, reliable, automatic escape apparatus which can be used to transport people safely out of a building during a fire emergency.

SUMMARY OF THE INVENTION

The present invention is directed to an improved descent apparatus which operates independently of elevators, stairways, and outside rescue equipment.

According to this invention, a self-braking descent apparatus is provided which includes a vertically oriented gear track mounted on a structure, such as a building, and a carriage mounted to move vertically in the gear track. This carriage includes a gear wheel having a plurality of gear teeth adapted to positively engage and interlock with the gear track, and the gear wheel is mounted on the carriage such that the gear wheel is rotatable with respect to the carriage. Means are provided for guiding the carriage along the gear track while maintaining a positive engagement between the gear wheel and the gear track such that the gear wheel is caused to rotate with respect to the carriage as the carriage moves along the gear track. Means are provided for positively securing at least one person to the carriage, and the carriage also includes one or more automatically actuated brakes which limit the rotational velocity of the gear wheel so as to control the downward velocity of the carriage automatically in such a manner as to protect person or persons supported by the carriage from injury due to excessive downward velocity.

In the preferred embodiment described in detail below, the carriage is provided with a centrifugal brake which is responsive to the rotational velocity of the gear wheel and acts automatically to limit the maximum angular velocity of the gear wheel, and therefore the maximum downward velocity of the carriage. In addition, this preferred embodiment includes a cam actuated brake which is automatically and repeatedly actuated by a cam track disposed on the structure adjacent the gear track. This cam brake operates repeatedly and periodically to slow the downward velocity of the carriage as it moves along the cam track.

The descent apparatus of this invention provides a number of important advantages. Since it is situated outside of the building and is entirely self-contained, it operates entirely independently of external power sources and can often be used when internal escape routes are disabled or blocked by smoke. Furthermore, the gear track is a relatively small, inconspicuous element which can readily be incorporated in the exterior surface of many buildings. For example, the gear track of this invention can be integrated with window washing guide rails already in place in many high-rise buildings. Furthermore, the descent apparatus of this invention operates entirely automatically once released, and the person being carried on the carriage therefore needs no special instruction in how to control the brakes of the carriage.

The invention itself, together with further objects and attendant advantages, will best be understood by reference to the following detailed description taken in conjunction with the accompanying drawings.

DETAILED DESCRIPTION OF THE PRESENTLY PREFERRED EMBODIMENT

Figure 1:
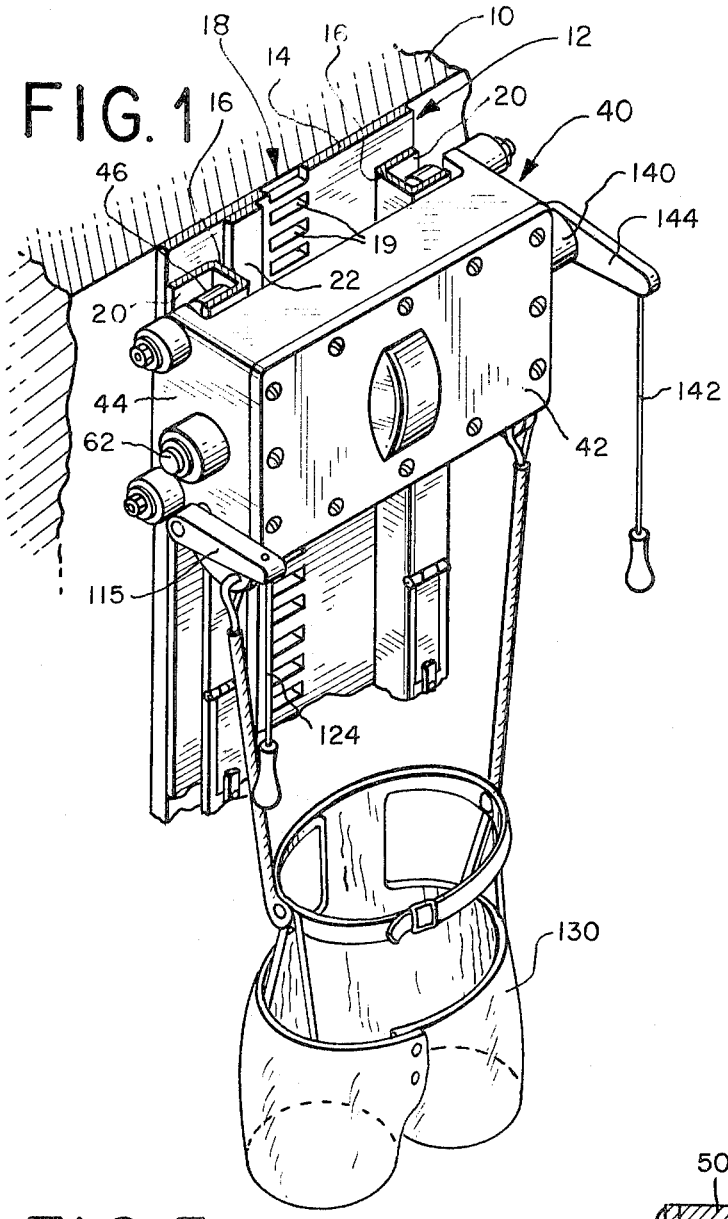
FIG. 1 is a perspective view of the presently preferred embodiment of this invention.

Turning now to the drawings, FIG. 1 shows an perspective view of a preferred embodiment of the emergency escape apparatus of this invention. As shown in FIG. 1, this apparatus includes a vertically oriented track, generally indicated by the reference numeral 12, which is rigidly mounted to an exterior surface of a structure such as a building 10. A carriage 40 is guided for vertical movement along the track 12, and means, such as a boatswain's chair 130, for securing one or more persons to the carriage 40 are suspended from the carriage 40. Preferably, the boatswain's chair 130 should securely hold the person in place in a comfortable sitting position. Alternate embodiments may employ multiple boatswain's chairs, or other means for reliably securing one or more persons to the carriage 40.

Figure 6:
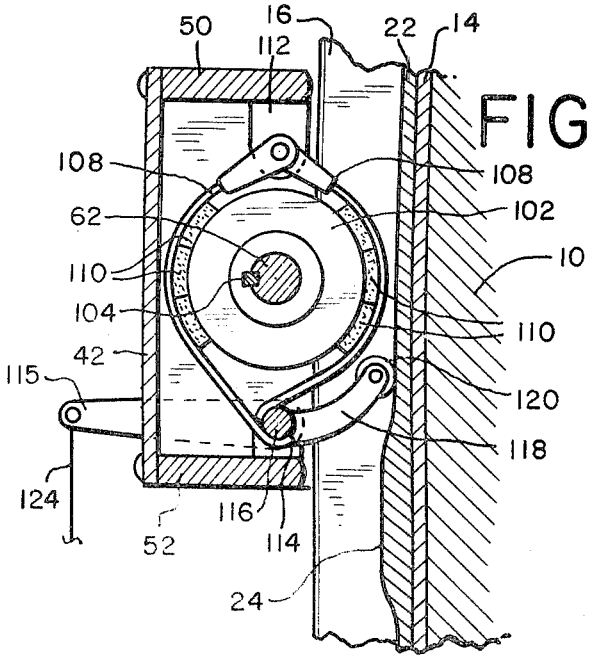
FIG. 6 is a sectional view taken along line 6—6 of FIG. 3.
Figure 3:
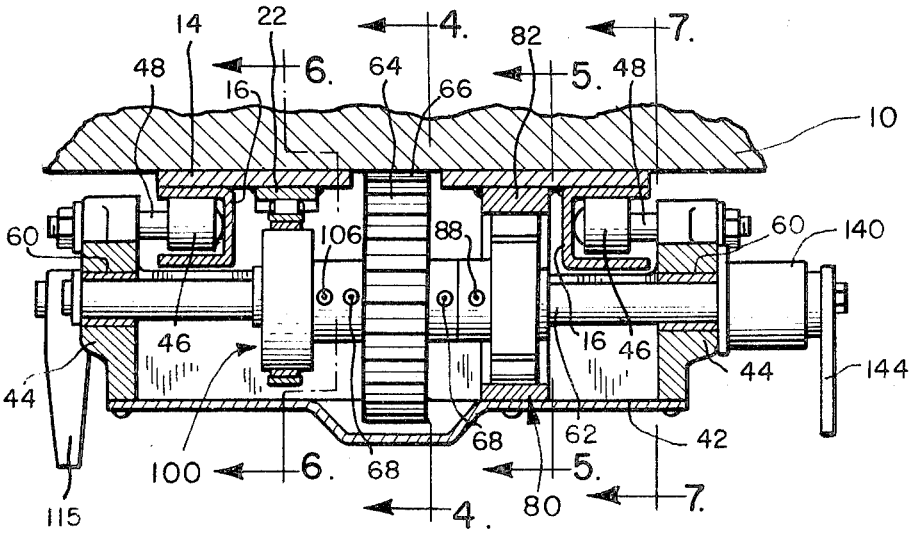
FIG. 3 is a sectional view taken along line 3—3 of FIG. 2.

As best shown in FIGS. 1, 3 and 6, the track 12 includes a plate 14 which defines a vertically oriented gear track 18. This gear track 18 comprises a vertical array of cut-outs 19 which extend vertically along the length the plate 14. These cut-outs 19 are regularly spaced, and in this preferred embodiment have a length of about four inches and a width in the range of $\frac{3}{4}$ to 1 inch. A pair of vertically oriented channels 16 are rigidly secured, as for example by welding, to the outer edges of the plate 14. In each case, the channels 16 face outwardly, and each channel 16 serves to define a respective guide track 20 formed by the inner surfaces thereof. Each of these guide tracks 20 extends along the length of the plate 14, substantially parallel to the gear track 18. In addition, a cam track 22 is also mounted on the plate 14 so as to extend vertically, substantially adjacent and parallel to the gear track 18. As best seen in FIG. 6, this cam track 22 defines a plurality of raised cam surfaces 24 which extend away from the plate 14. In this preferred embodiment, these cam surfaces 24 are spaced at regular intervals along the length of the cam track 22, such that the separation between adjacent cam surfaces 24 is about ten feet.

Figure 7:
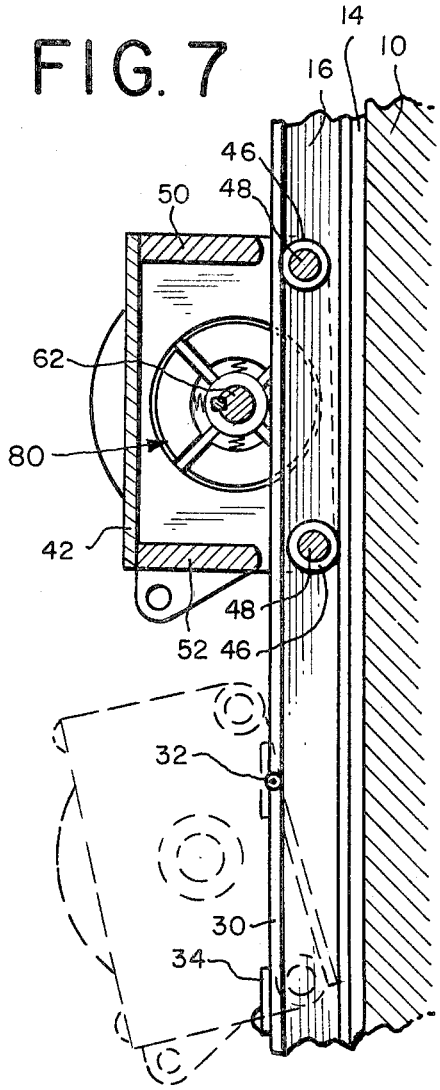
FIG. 7 is a sectional view taken along line 7—7 of FIG. 3.
Figure 2:
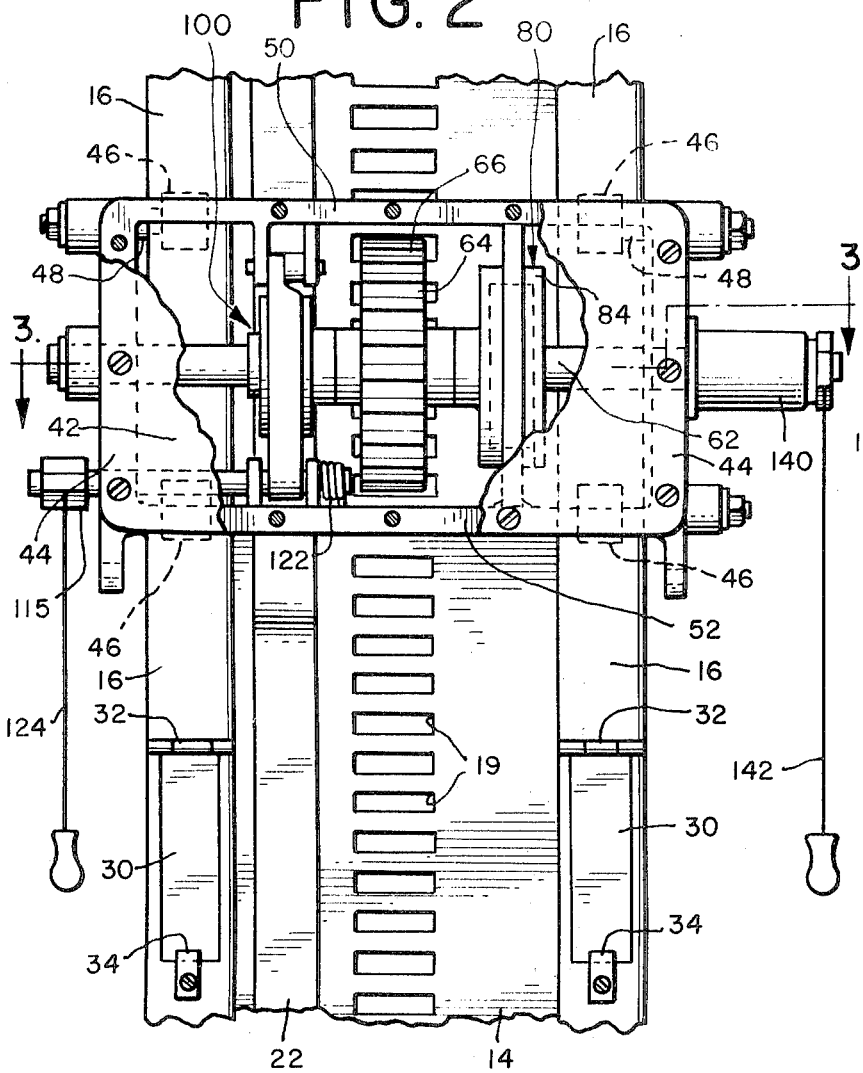
FIG. 2 is an elevational view in partial cutaway of the embodiment of FIG. 1.
Figure 4:
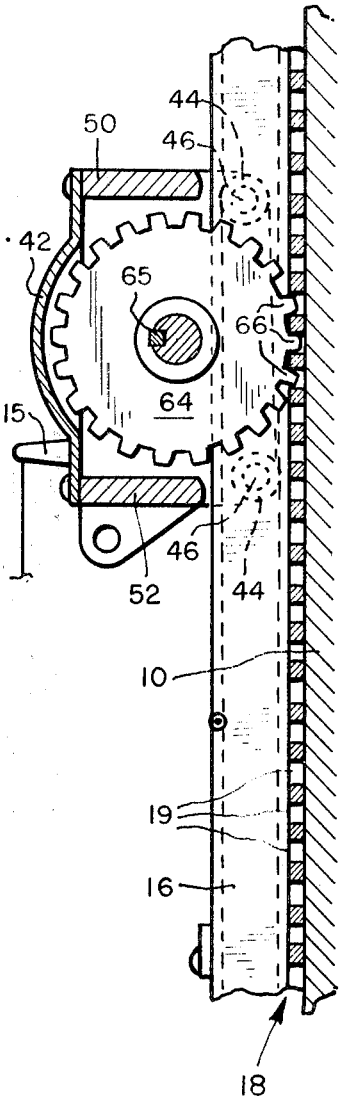
FIG. 4 is a sectional view taken along line 4—4 of FIG. 3.

The track 12 also defines at least one pair of hinged door panels 30. As shown in FIGS. 2 and 7, each of these door panels 30 is situated in a respective one of the two channels 16. Each of the door panels 30 is pivotably connected at its uppermost edge to the respective channel 16 by means of a hinged joint 32 such that the door panel 30 is free to swing inwardly, towards the plate 14. A stop surface 34 is rigidly mounted to the channel 16 adjacent the lower end of the respective door panel 30 to limit the outward movement of the door panel 30. Thus, each door panel 30 is free to move inwardly, as shown in dotted lines in FIG. 7, yet is substantially prevented from moving past the position shown in solid lines in FIG. 7. As will be explained below, the door panels 30 are used to install the carriage 40 in the guide tracks 20.

As shown in FIGS. 1–4, the carriage 40 of this embodiment includes a rigid frame made up of two opposed side plates 44, a top plate 50 and a bottom plate 52. An outer housing 42 is secured to this frame. Each of the side plates 44 serves to mount a pair of guide rollers 46, each of which is rotatably mounted on a respective shaft 48. The guide rollers 46 are positioned on the side plates 44 so as to fit within the respective channels 16. Thus, when the carriage 40 is mounted with the guide rollers 46 engaged with the guide tracks 20, the center housing 42 is oriented substantially parallel to the gear track 18 and the side plates 44, the top plate 50 and the bottom plate 52 are oriented substantially perpendicular to the gear track 18.

A pair of bushings 60 are rigidly mounted to the side plates 44. These bushings 60 serve to mount a solid shaft 62 for rotation with respect to the carriage 40. This shaft 62 in turn serves to mount a large gear wheel 64. This gear wheel 64 is provided with a plurality of gear teeth 66 sized and disposed to engage and positively interlock with the cutouts 19 of the gear track 18. The gear wheel 64 is rotationally locked on the shaft 62 by means of a key 65 and is held in axial position on the shaft 62 by means of set screws 68. Thus, the shaft 62 and the gear wheel 64 rotate as a unit. The guide rollers 46 cooperate with the guide tracks 20 to maintain the gear wheel 64 in engagement with the gear track 18. Thus, as the carriage 40 moves down the track 12, the gear track 18 causes the gear wheel 64 and therefore the shaft 62 to rotate with an angular velocity proportional to the downward velocity of the carriage 40. In this preferred embodiment the gear wheel 64 is about twelve inches in diameter and about three inches in thickness.

Figure 5:
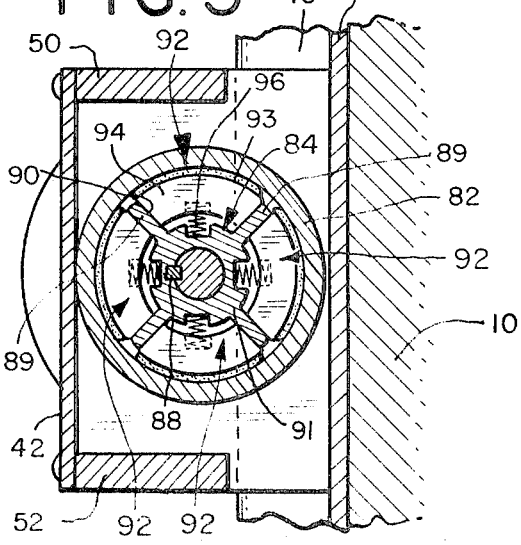
FIG. 5 is a sectional view taken along line 5—5 of FIG. 3.

Also mounted on the shaft 62 is a centrifugal brake 80, which is shown in detail in FIGS. 2, 3 and 5. This centrifugal brake 80 includes a non-rotating brake drum 82 which is rigidly mounted to the carriage 40. In addition, a brake shoe housing 84 is mounted on the shaft 62 by means of a key 86 and a set screw 88 such that the brake shoe housing 84 rotates in unison with the shaft 62. As best seen in FIG. 5, the brake shoe housing 84 includes four radial walls 89 extending outwardly from a hub 91. These walls 89 cooperate with the hub 91 to define four arcuate recesses 90, each of which houses a respective brake shoe 92. Each of these brake shoes 92 comprises an outer brake liner 93 and an inner centrifugal weight 94. The brake shoes 92 are free to move radially inside the arcuate recesses 90 and are biased outwardly into contact with the brake drum 82 by means of the springs 96. The springs 96 should be chosen to provide the desired degree of braking without locking the shaft 62 against rotation.

The centrifugal brake 80 operates to apply an increased braking force to the shaft 62 in response to increased angular velocity of the shaft 62. This is because rotation of the brake shoe housing 84 causes the brake shoes 92 to press against the brake drum 82 with increased force, thereby increasing the braking action of the centrifugal brake 80. In some embodiments of this invention, it may be desirable to use a gear box (not shown) to cause the brake shoe housing 84 to rotate at a greater angular velocity than that of the shaft 62 in order to increase the centrifugal action of the brake 80. As will be explained in greater detailed below, the centrifugal brake 80 serves to limit the maximum angular velocity of the shaft 62.

As best shown in FIGS. 2, 3 and 6, a cam brake 100 is also mounted on the shaft 62. This cam brake 100 includes a brake drum 102 which is keyed to rotate with the shaft 62 by means of a key 104 and is held in axial position on the shaft 62 by means of a set screw 106. Thus, the brake drum 102 rotates with the same angular velocity as that of the gear wheel 64. As best shown in FIG. 6, the brake drum 102 is surrounded by a brake band 108. This brake band 108 is formed in two halves, each of which is fixedly mounted at one end to a first pivot 112 which is rigidly mounted to the carriage 40. In addition, the other end of each of the brake bands 108 is affixed to a second pivot 114 which includes a rotatable pivot shaft 116. A plurality of brake pads 110 are mounted on the interior surfaces of both halves of the brake band 108 to bear against the brake drum 102. A follower arm 118 is mounted to the pivot shaft 116 so as to control the angular position of the pivot shaft 116. This follower arm 118 terminates in a cam follower 120 which bears on the cam track 22. A torsion spring 122 is provided to bias the cam follower 120 against the cam track 22.

The cam brake 100 is controlled by the cam track 22 such that when the cam follower 120 is moved away from the plate 14 by one of the plurality of cam surfaces 24, the pivot shaft 116 is rotated so as to tighten the brake band 108 against the brake drum 102, thereby increasing the braking action of the cam brake 100. Similarly, when the cam follower 120 moves past one of the cam surfaces 24, the spring 122 moves the follower arm 118 toward the plate 14, thereby relaxing the braking action of the cam brake 100. A cord 124 is mounted on the pivot shaft 116 by means of a lever arm 115 to allow manual application of the cam brake 100.

As shown in FIG. 3, means such as a releasable ratchet 140 are provided for locking the gear wheel 64 with respect to the carriage 40 so as to lock the carriage 40 in position on the track 12. This releasable ratchet 140 operates in its engaged state to allow the shaft 62 to rotate in a direction corresponding to upward movement of the carriage 40 while reliably locking the shaft 62 against rotation corresponding to downward movement of the carriage 40. However, downward movement of the cord 142 and the lever arm 144 releases the ratchet 140, allowing the carriage 40 to descend at a rate controlled by the brakes 80,100.

Having described the structure of the presently preferred embodiment of this invention, the operation of this embodiment can now be discussed. As mentioned previously, the carriage 40 is free to move vertically in the track 12, guided by the guide rollers 46. These guide rollers are preferably about four inches in diameter and they serve to hold the carriage 40 at a predetermined spacing from the gear track 18 such that the gear wheel 64 is positively engaged with the gear track 18.

Once a person is secured in the boatswain's chair 130 and the ratchet 140 has been released so as to allow the gear wheel 64 to rotate, the carriage 40 descends in the track 12, and the centrifugal brake 80 and the cam brake 100 serve automatically to apply a braking action which limits the maximum downward velocity of the carriage 40 to a safe value. The centrifugal brake 80 and the cam brake 100 should be designed to operate independently, such that either can provide adequate braking to maintain a safe rate of descent. Preferably, the maximum rate of descent of the loaded carriage 40 is no greater than ten feet per second. In operation, the centrifugal brake 80 applies an increasingly severe braking action as the downward velocity of the carriage 40 increases, and the braking force of the centrifugal brake 80 should be chosen such that this maximum velocity is no greater than about ten feet per second. In addition, the cam brake 100 is automatically and periodically applied by the cam surfaces 24 so as to slow the downward velocity of the carriage 40 repeatedly as it passes past successive cam surfaces 24. In some embodiments of this invention it may be preferable to provide a particularly steep cam surface 24 near the bottom of the track 12 so as to substantially to slow or even stop the downward movement of the carriage 40 once the boatswain's chair 130 is near ground level. If desired, air bags (not shown) can be provided at the bottom of the guide track 12 along with means (not shown) for automatically inflating the air bags when the carriage 40 passes a predetermined point in the track 12 such that the air bags are fully inflated when the boatswain's chair 130 reaches ground level.

In use, the carriage 40 would be positioned at some height above ground level in the track 12. The carriage 40 can be engaged in the guide track 20 by pushing the guide rollers 46 through the door panels 30 (as shown in dotted lines in FIG. 7), allowing the door panels 30 to assume the position shown in solid lines in FIG. 7, and then raising the carriage 40 to the position shown in FIG. 1. The force of gravity serves to keep the door panels 30 in the closed position so as to preserve a smooth guide track 20, and the ratchet 140 serves to hold the carriage 40 in position on the track 12.

A user of the emergency escape apparatus of this invention first straps himself in the boatswain's chair 130, and then steps out of the building so as to suspend his weight from the carriage 40. Once he is properly in position outside the building, he unlocks the carriage 40 by pulling downwardly on the cord 142 so as to allow the carriage 40 to begin its descent. As previously explained, the centrifugal brake 80 and the cam brake 100 serve automatically to limit the maximum downward velocity of the carriage 40 to a safe value. The user can further reduce his downward velocity by modulating the action of the cam brake 100 by pulling on the cord 124. Once the user reaches ground level he merely unstraps himself from the boatswain's chair 130 and walks away from the building. Means (not shown) may be provided to allow persons in upper carriages to unlock and release lower carriages positioned in the same track 12. In this way, multiple carriages 40 can be installed in a common track 12. Of course, in many applications it will be preferable to provide multiple tracks 12 on the outside of the building so as to allow adequate capacity. In addition, more than one boatswain's chair 130 can be suspended from a single carriage 40 in order further to increase the rescue capacity of the system.

From the foregoing, it should be apparent that an escape apparatus has been described which reliably transports persons down the outside of a building with automatic braking that requires no active control by the person using the apparatus. The track of this apparatus can readily be integrated with the exterior surface of a building, and either the carriage can be stored outside the building, engaged in the track for use when needed, or alternately the carriage can be stored inside the building for installation in the track in times of emergency. In this case, it may be preferable to mount the guide rollers in a hinged manner such that they can be positioned in the guide tracks and then snap locked in place. Preferably, the track and the carriage should be formed of aluminum or a similar lightweight material to provide a compact, lightweight system.

Of course, it should be understood that various changes and modifications to the preferred embodiment described above will be apparent to those skilled in the art. For example, disc brakes can be substituted for the drum-type cam brake shown, and such disc brakes may act directly on the gear wheel to minimize the size and mass of the carriage. In addition, it may not be necessary to use two independent brakes in all embodiments of the invention, and other types of self-applying brakes may be adapted for use with the carriage of this invention. It is therefore intended that the foregoing detailed description be regarded as only illustrative of the presently preferred embodiment of the invention, and that it be understood that it is the following claims, including all equivalents, which define the scope of the invention.

I claim:

1. A self-braking descent apparatus comprising:

a vertically oriented gear track mounted on a structure;

a carriage;

a gear wheel having a plurality of gear teeth adapted to positively engage and interlock with the gear track;

means for mounting the gear wheel on the carriage such that the gear wheel is rotatable with respect to the carriage;

means for guiding the carriage along the gear track while maintaining a positive engagement between the gear wheel and the gear track such that the gear wheel is caused to rotate with respect to the carriage as the carriage moves along the gear track;

means for positively securing at least one person to the carriage; and means for automatically braking the rotation of the gear wheel to control the downward velocity of the carriage automatically so as to protect a person supported by the securing means from injury due to excessive downward velocity, said braking means comprising:

a brake;

a vertically oriented cam track mounted on the structure near the gear track, said cam track defining a plurality of spaced cam surfaces; and means, responsive to the cam track, for periodically and automatically increasing the braking action of the brake as the carriage descends such that the brake is applied as the carriage passes each of the successive cam surfaces, thereby automatically limiting the downward velocity of the carriage to velocities less than a predetermined value.

2. A self-braking emergency escape apparatus for transporting persons down from a building, said apparatus comprising:

a vertically oriented gear track mounted to an exterior surface of the building;

a pair of guide channels, each mounted at a respective side of the gear track and each serving to define respective inner and outer guide tracks;

at least one set of aligned door panels which form part of the outer guide tracks, said door panels movable between open and closed positions;

a carriage;

a gear wheel having a plurality of gear teeth adapted to positively engage and interlock with the gear track;

means for mounting the gear wheel on the carriage such that the gear wheel is rotatable with respect to the carriage;

means for guiding the carriage along the gear track while maintaining a positive engagement between the gear wheel and the gear track such that the gear wheel is caused to rotate with respect to the carriage as the carriage moves along the gear track, said guiding means comprising at least two guide rollers, each positioned to roll within a respective one of the guide channels, said guide rollers sized to move into and out of the guide channels when the door panels are in the open position, and to remain securely within the guide channels when the door panels are in the closed position, such that the carriage can readily be installed on and removed from the gear track;

means for positively securing at least one person to the carriage; and means for automatically braking the rotation of the gear wheel to control the downward velocity of the carriage automatically so as to protect a person supported by the securing means from injury due to excessive downward velocity.

3. The invention of claim 1 or 2 wherein the braking means comprises:

a brake; and brake applying means for automatically increasing the braking action of the brake in response to increased rotational velocity of the gear wheel;

said brake and brake applying means cooperating to maintain the downward velocity of the carriage below a predetermined value.

4. The invention of claim 2 wherein the braking means comprises:

a brake;

a vertically oriented cam track mounted on the structure near the gear track, said cam track defining a plurality of spaced cam surfaces; and means, responsive to the cam track, for periodically and automatically increasing the braking action of the brake as the carriage descends such that the brake is applied as the carriage passes each of the successive cam surfaces, thereby automatically limiting the downward velocity of the carriage to velocities less than a predetermined value.

5. The invention of claim 4 further comprising:

manually activated means for applying the brake.

6. The invention of claim 1 or 2 further comprising:

means for releasably locking the carriage in position on the gear track.

7. The invention of claim 1 or 2 wherein the securing means comprises a boatswain's chair.

8. A self-braking emergency escape apparatus for transporting persons down from a building, said apparatus comprising:

a vertically oriented gear track mounted to an outside surface of the building;

a vertically oriented cam track mounted to the outside surface of the building parallel to the gear track, said cam track defining a plurality of spaced cam surfaces;

at least one vertically oriented guide track mounted to the outside surface of the building parallel to the gear track;

a carriage;

a gear wheel having a plurality of gear teeth adapted to interlock with and positively engage the gear track;

means for rotatably mounting the gear wheel on the carriage;

means for guiding the carriage along the guide track such that the gear wheel positively engages the gear track and the gear wheel rotates as the carriage moves vertically along the guide track;

centrifugal brake means, coupled to the gear wheel, for automatically braking downward movement of the carriage with a braking action that automatically increases in response to increased angular velocity of the gear wheel;

cam brake means, coupled to the gear wheel, for automatically and periodically braking downward movement of the carriage with a braking action that automatically increases when the carriage passes one of the plurality of cam surfaces, said cam brake means comprising a cam brake, a cam follower mounted on the carriage to follow the cam track, and means for applying the cam brake in response to movement of the cam follower over one of the plurality of cam surfaces; and means for positively securing at least one person to the carriage.

* * * * *